United States Patent [19]

Alberghini et al.

[11] Patent Number: 5,054,632

[45] Date of Patent: Oct. 8, 1991

[54] HOT FILL CONTAINER WITH ENHANCED LABEL SUPPORT

[75] Inventors: Alfred C. Alberghini, Dunwoody; David A. Brunson, Marietta; Stephen R. Lynn, Douglasville, all of Ga.

[73] Assignee: Sewell Plastics, Inc., Atlanta, Ga.

[21] Appl. No.: 556,535

[22] Filed: Jul. 23, 1990

[51] Int. Cl.[5] ..... B65D 1/02; B65D 1/42; B65D 23/08

[52] U.S. Cl. ..... 215/1 C; 40/310; 220/609; 220/675

[58] Field of Search ..... 215/1 C; 220/609, 675; D9/376, 378, 408; 40/310

[56] References Cited

U.S. PATENT DOCUMENTS

| | | | |
|---|---|---|---|
| D. 295,381 | 4/1988 | Papa | D9/392 |
| D. 295,382 | 4/1988 | Rogler | D9/392 |
| 4,381,061 | 4/1983 | Cerny et al. | 215/1 C |
| 4,385,089 | 5/1983 | Bonnebat et al. | 215/1 C X |
| 4,542,029 | 9/1985 | Caner et al. | 426/127 |
| 4,805,788 | 2/1989 | Akiho | 215/1 C |
| 4,863,046 | 9/1989 | Collette et al. | 215/1 C |
| 4,877,141 | 10/1989 | Hayashi et al. | 215/1 C |
| 4,946,053 | 8/1990 | Conrad | 220/94 A X |

FOREIGN PATENT DOCUMENTS

| | | | |
|---|---|---|---|
| 90987 | 3/1968 | France | 215/1 C |
| 7126310 | 8/1962 | Japan | 215/1 R |
| 606383 | 8/1983 | Japan | 215/1 R |
| 2218395 | 11/1989 | United Kingdom | 215/1 C |

*Primary Examiner*—Sue A. Weaver
*Attorney, Agent, or Firm*—Locke Reynolds

[57] ABSTRACT

A container made of thermoplastic material such as PET includes a bottom portion, a neck portion, and an intermediate body portion including at least two circumferential rows of panels for providing controlled volumetric reduction of the container. A land separates each adjacent pair of panels in each row. The rows of panels are staggered with respect to each other such that the lands of one row are vertically aligned with the panels of any adjacent row. The design distributes circumferentially the vertical and horizontal support for any label applied to the label panel of the container while still providing the desired panel movement in response to the existence of a partial vacuum within the container due to hot filling.

13 Claims, 1 Drawing Sheet

HOT FILL CONTAINER WITH ENHANCED LABEL SUPPORT

BACKGROUND OF THE INVENTION

The present invention relates to hollow blow-molded containers of biaxially oriented thermoplastic materials especially adapted to be filled with a hot liquid or semi-liquid product and hermetic sealed. The invention particularly relates to improvements in container design to achieve a filled container which when cooled retains a desired container configuration despite the development of a partial vacuum within the container and provides enhanced support of any label applied to the container.

When a container is filled with a liquid or semi-liquid material, it is conventional packaging practice to leave a small, unfilled volume at the top of the container, called the head space. Typically, the head space of a fully filled container comprises about five percent of the total container volume. When such container filling occurs with the filling material in a hot condition, the air or gas in the head space is heated to about the same temperature as the filling material. After the container is filled, the container is quickly hermetically sealed with a cap preventing the influx of any air or gas within the container. Typically, such capping occurs within a matter of seconds so that no appreciable cooling of the container contents occurs prior to the hermitic sealing.

As the product within the container cools, the material forming the liquid or semi-liquid contents shrinks in volume thereby enlarging the head space typically by 80% or more. This increase in gas volume causes a decrease in pressure in general accord with Boyle's law. The drop in temperature of the gas within the head space also contributes to a decrease in pressure in general accordance with Gay-Lussac's law. The combined decrease in pressure is sufficient for a significant partial vacuum to develop. Thus, in containers having substantially fixed dimensions, such as those constructed of glass, a partial vacuum develops which may be exhibited in an elastic inward deflection of the cap closing the fixed dimensional container. In containers having more flexible walls, the wall of the container often elastically deforms and at least partially collapses to the extent necessary to substantially reduce or eliminate the partial vacuum within the container. Such container deformation is commonly referred to as "paneling."

The paneling of a sealed container due to a cooling of the product within the container often makes the container appear misshapened, but generally does not detrimentally affect the quality of the product held by the container. However, there is often some consumer resistance to purchasing misshapened containers possibly based in a misguided assumption that the container is somehow less than full or the contents is no longer satisfactory. In addition to any consumer resistance to a randomly paneled container due to the undesirable appearance, it has been recognized that the container itself loses side wall symmetry and, hence, column strength which often prevents stacking of the containers for display or storage. Due in large part to cost considerations, it has been found desirable to lower the thickness of the side wall in the containers thus inherently making the side wall even more susceptible to vacuum induced paneling.

To diminish this consumer resistance to paneled containers, and to provide enhanced side wall symmetry so as to permit stacking, some containers have been designed to incorporate special features called vacuum deflection panels intended to be displaced inwardly in response to product shrinkage and cooling. The early solutions to the problem concentrated on providing structure for the ends, particularly the bottoms, of containers which would flex upwardly in response to a lowering of pressure within the container. More recently, various designs of side structures have been attempted to achieve the same result. Examples of such containers are to be found in U.S. Pat. Nos. 4,381,061; 4,542,029; 4,805,788; 4,863,046; and, 4,877,141. Many of these patents are directed to blow-molded containers of a biaxially oriented polymer such as polyethylene terephthalate resin (hereinafter referred to merely as PET). The PET containers are flexible yet self-supporting, that is, they do not collapse under their own weight.

Typically, the vacuum deflection panels in blow-molded PET containers of the prior art have been initially formed so they are slightly concave with the action of the partial vacuum within the container causing the panel to become increasingly concave as well as inwardly displaced. Generally, the side structure has consisted of inwardly indented panels adapted to flex still further inwardly into the container to offset the decrease in volume due to the cooling of the liquid product as well as the cooling of the gas within the head space. To reduce the occurrence of any misplaced container wall deflection, it has been found to be desirable to include various wall strengthening features and panel separating features so as to provide the desired panel movement in response to the existence of the partial vacuum.

To ensure that the thin-walled PET containers have sufficient rigidity to withstand any panel collapse and to withstand the initial hot filling, the containers are typically thermally treated or tempered either during or subsequent to the blowing operation so as to enhance the stability of the container. This thermal treatment has the effect of rigidifying the container when cool so that the deflection of the panels becomes increasingly difficult. To offset this reduced deflection of each panel, the number of panels is increased to accommodate the required volumetric change in the container.

The vacuum deflection panels have often been included in a cylindrical body portion of a container, generally referred to as the label panel where, typically, a label is applied to the container. While the presence of the label tends to hide the vacuum deflection panels, the presence of a large number of such panels significantly diminishes the label support thus making the label appear wrinkled or otherwise distorted thereby detracting from the product appearance. This undesirable appearance again leads to some consumer resistance.

SUMMARY OF THE INVENTION

To overcome these and other related problems, a container made in accordance with the present invention includes a plurality of rows of panels circumferentially spaced around the periphery of a container body. A land separates each adjacent pair of panels in each row. The rows of panels are staggered with respect to each other such that the lands of one row are vertically aligned with the panels of any adjacent row. A circumferential band separates each of the plurality of rows of panels from each other.

In the preferred embodiment of a container made in accordance with the present invention, the circumferential band includes a circumferential rib. Each of the panels of each row are of about equal vertical and horizontal dimension, and can be round or square. In the preferred embodiment, each of the panels of each row comprises a generally planar central section and outwardly sloping sections joining the upper and lower boundaries of the generally planar central section to the generally cylindrical portion.

One feature of the present invention is the presence of one or more circumferential bands intermediate the upper and lower margins of the label panel. This feature has the advantage of increasing the circumferential support for any label applied to the label panel of the container.

Another feature of the present invention is the arrangement of the circumferential rows of panels with lands separating each adjacent pair of panels in each row, the rows of panels being staggered with respect to each other such that the lands of one row are vertically aligned with the panels of any adjacent row. This feature has the advantage of circumferentially distributing the vertical support for any label applied to the label panel of the container.

These and other features and advantages of the present invention will become apparent to those skilled in the art upon consideration of the following detailed description of preferred embodiments exemplifying the best mode of carrying out the invention as presently perceived. The detailed description particularly refers to the accompanying drawings.

DESCRIPTION OF THE PREFERRED EMBODIMENT

Figure 1:
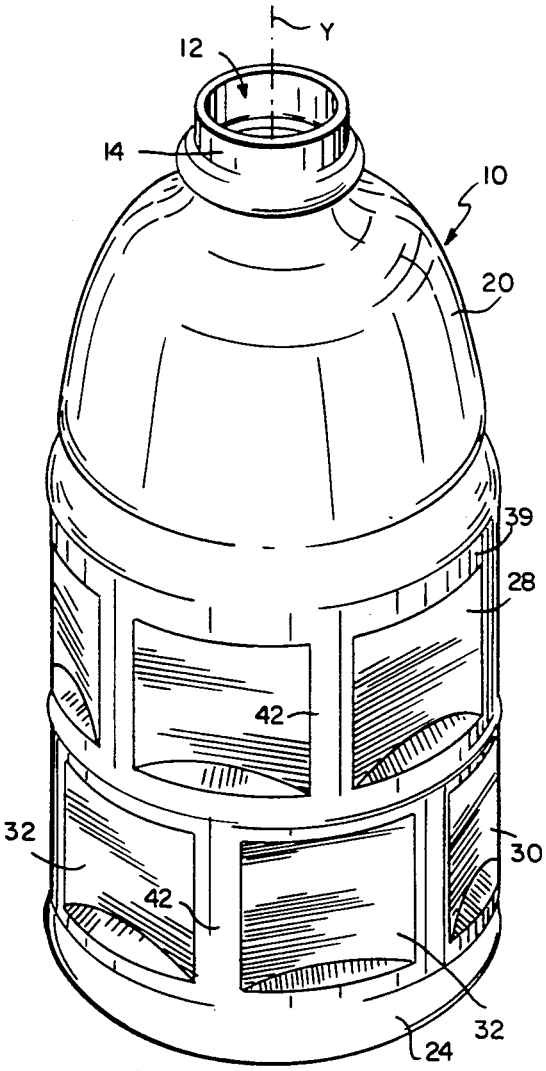
FIG. 1 is a perspective view of a container in accordance with the present invention.
Figure 2:
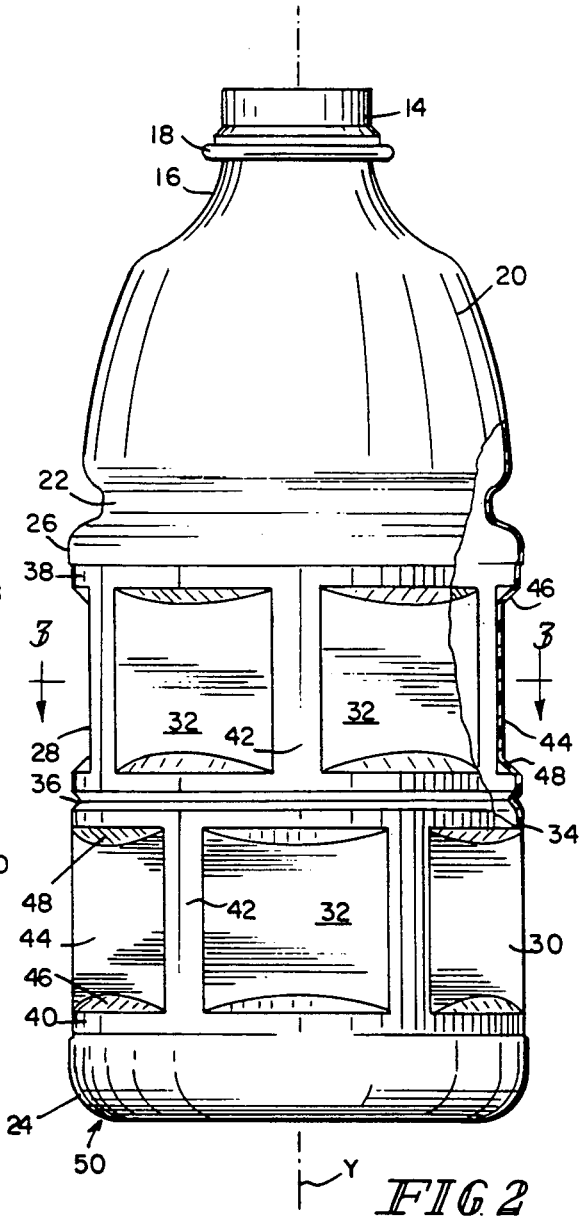
FIG. 2 is side elevation view of the container shown in FIG. 1 partially broken away.

A container 10 in accordance with the present invention is illustrated in the accompanying drawings. The container 10 is generally symmetric about a vertical axis Y passing through the center of mouth 12 which provides access to the interior of the container 10. The mouth 12 is defined by a finish 14 which can include features adapted to mate with a cap (not shown) of conventional design so as to hermitically seal the container. A neck portion 16 below support ring 18 flares outwardly to shoulder portion 20 which extends downwardly to an inwardly indented circumferential band 22. Between band 22 and base 24 is a generally cylindrical body portion 26.

The cylindrically body portion 26 includes two circumferential rows 28 and 30 of panels 32, the panels providing for a controlled reduction of volume of the container in response to the presence of a partial vacuum within the container. The two rows 28 and 30 of panels are separated from each other by a circumferential land 34 including an inwardly extending rib 36. The cylindrical land 34 has a radius equal to that of an upper margin 38 and a lower margin 40 of the label panel 39.

Each horizontally adjacent pair of panels 32 are separated by a vertical land 42. The rows 28 and 30 are staggered with respect to each other such that the vertical lands 42 in one row are aligned approximately with the center of the panels 32 of the adjacent row. This staggering of the vertical lands 42 in each of the adjacent rows coupled with the presence of the intermediate circumferential land 34 enhances the support provided in a label applied over the plurality of panels 32.

In the illustrated preferred embodiment, each of the panels 32 includes a generally planar central section 44 and outwardly sloping sections 46 and 48 joining the upper and lower boundaries of the generally planar central portion 44 to adjacent cylindrical portions 34 and 38 or 40.

Figure 3:
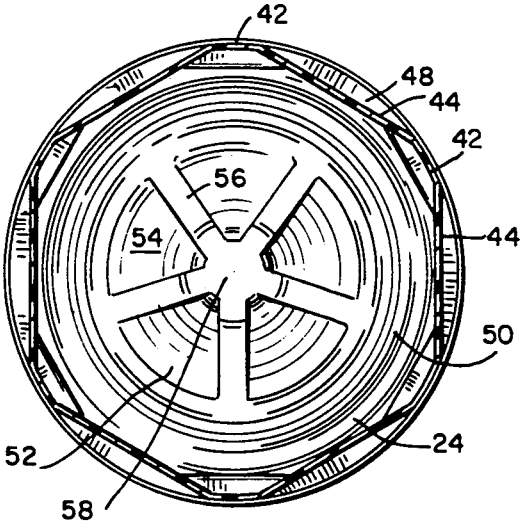
FIG. 3 is a sectional view of the container shown in FIG. 2 taken along line 3—3.

The base 24 is more fully illustrated in FIG. 3 to include a generally circular seating ring 50 and an upwardly domed central portion 52 including lands 54 and radial ribs 56 extending between a center portion 58 and the seating ring 50.

The container 10 is preferably made by blow-molding a PET parison within a blow mold, and tempering the blown container in accordance with the practices of U.S. Pat. No. 4,385,089, hereby incorporated by reference. The panels 32 are formed so as to be flexible with respect to the cylindrical wall portion 26 for displacement inwardly in response to product shrinkage and cooling. While the Figs. merely illustrate there to be two rows of vacuum panels 32, it will be appreciated that the number of rows of panels and the size and shape of the panels is subject to design variation depending on the overall size of the container, the temperature and amount of material to be filled into the container, an other variables known to those skilled in the art.

Although the invention has been described in detail with reference to the illustrated preferred embodiment, variations and modifications exist within the scope and spirit of the invention as described and as defined in the following claims.

What is claimed is:

1. A container made of thermoplastic material comprising: a bottom portion, a neck portion, and an intermediate body portion including at least two circumferential rows of panels including means for providing controlled volumetric reduction of the container, a land separating each adjacent pair of panels in each row, the rows of panels being staggered with respect to each other such that the lands of one row are vertically aligned with the panels of any adjacent row.

2. The container of claim 1 further comprising a circumferential band separating each of the at least two circumferential rows of panels from each other.

3. The container of claim 2 wherein the circumferential band includes a circumferential rib.

4. The container of claim 1 wherein each of the panels of each row are of equal vertical and horizontal dimension.

5. The container of claim 4 wherein each of the panels are generally square.

6. The container of claim 1 wherein each of the panels of each row are generally planar in transverse cross-section.

7. The container of claim 1 wherein the body portion comprises a lower generally cylindrical portion and an upper shoulder portion, the rows of panels being confined to the lower generally cylindrical portion.

8. The container of claim 7 wherein each of the panels of each row comprises a generally planar central section and outwardly sloping sections joining the upper and lower boundaries of the generally planar central section to the generally cylindrical portion.

9. The container of claim 7 further comprising a circumferential rib separating the upper shoulder portion and the lower generally cylindrical portion.

10. The container of claim 1 wherein said thermoplastic material is polyethylene terephthalate.

11. A container made of thermoplastic material especially adapted for hot filling comprising: a bottom portion, a neck portion, and a generally cylindrical intermediate body portion including at least two circumferential rows of panels including means for providing controlled volumetric reduction of the container in response to the presence of a partial vacuum within the container, a land separating each adjacent pair of panels in each row, a circumferential band separating each of the at least two circumferential rows of panels from each other, the rows of panels being staggered with respect to each other such that the lands of one row are vertically aligned with the panels of any adjacent row.

12. The container of claim 11 wherein each of the panels of each row comprises a generally planar central section and outwardly sloping sections joining the upper and lower boundaries of the generally planar central section to the generally cylindrical body portion.

13. The container of claim 11 further comprising circumferential land portions at the upper margin of the uppermost row of panels and at the lower margin of the lowermost row of panels, and wherein the circumferential land portions, the lands in each row, and the circumferential bands between rows define a label supporting region within the general cylindrical intermediate body portion.

* * * * *